US008367294B2

(12) United States Patent
Nosella et al.

(10) Patent No.: US 8,367,294 B2
(45) Date of Patent: Feb. 5, 2013

(54) TONER PROCESS

(75) Inventors: Kimberly D. Nosella, Mississauga (CA); Guerino G. Sacripante, Oakville (CA)

(73) Assignee: Xerox Corporation, Norwalk, CT (US)

( * ) Notice: Subject to any disclaimer, the term of this patent is extended or adjusted under 35 U.S.C. 154(b) by 436 days.

(21) Appl. No.: 12/717,343

(22) Filed: Mar. 4, 2010

(65) Prior Publication Data

US 2010/0159387 A1 Jun. 24, 2010

Related U.S. Application Data

(63) Continuation-in-part of application No. 12/056,337, filed on Mar. 27, 2008.

(51) Int. Cl.
*G03G 5/00* (2006.01)

(52) U.S. Cl. ..... 430/137.14

(58) Field of Classification Search ..... 430/137.14
See application file for complete search history.

(56) References Cited

U.S. PATENT DOCUMENTS

| | | | | |
|---|---|---|---|---|
| 3,590,000 | A | 6/1971 | Palermiti et al. | |
| 3,800,588 | A | 4/1974 | Larson et al. | |
| 3,847,604 | A | 11/1974 | Hagenbach et al. | |
| 4,295,990 | A | 10/1981 | Verbeek et al. | |
| 4,298,672 | A | 11/1981 | Lu | |
| 4,338,390 | A | 7/1982 | Lu | |
| 4,935,326 | A | 6/1990 | Creatura et al. | |
| 4,937,166 | A | 6/1990 | Creatura et al. | |
| 5,236,629 | A | 8/1993 | Mahabadi et al. | |
| 5,290,654 | A | 3/1994 | Sacripante et al. | |
| 5,302,486 | A | 4/1994 | Patel et al. | |
| 5,330,874 | A | 7/1994 | Mahabadi et al. | |
| 5,342,724 | A | 8/1994 | Wilson | |
| 5,344,738 | A | 9/1994 | Kmiecik-Lawrynowicz et al. | |
| 5,346,797 | A | 9/1994 | Kmiecik-Lawrynowicz et al. | |
| 5,364,729 | A | 11/1994 | Kmiecik-Lawrynowicz et al. | |
| 5,403,693 | A | 4/1995 | Patel et al. | |
| 5,418,108 | A | 5/1995 | Kmiecik-Lawrynowicz et al. | |
| 5,501,935 | A | 3/1996 | Patel et al. | |
| 5,527,658 | A | 6/1996 | Hopper et al. | |
| 5,585,215 | A | 12/1996 | Ong et al. | |
| 5,650,255 | A | 7/1997 | Ng et al. | |
| 5,650,256 | A | 7/1997 | Veregin et al. | |
| 5,853,943 | A | 12/1998 | Cheng et al. | |
| 6,063,827 | A | 5/2000 | Sacripante et al. | |
| 6,120,967 | A | 9/2000 | Hopper et al. | |
| 6,214,507 | B1 | 4/2001 | Sokol et al. | |
| 6,593,049 | B1 | 7/2003 | Veregin et al. | |
| 6,756,176 | B2 | 6/2004 | Stegamat et al. | |
| 6,767,684 | B1 | 7/2004 | Patel et al. | |
| 6,808,851 | B2 | 10/2004 | Bartel et al. | |
| 6,830,860 | B2 | 12/2004 | Sacripante et al. | |
| 7,037,633 | B2 | 5/2006 | Hopper et al. | |
| 7,695,884 | B2 * | 4/2010 | Vanbesien et al. | 430/110.2 |
| 2006/0222991 | A1 | 10/2006 | Sacripante et al. | |
| 2007/0155990 | A1 * | 7/2007 | Stergiades et al. | 564/219 |
| 2008/0153025 | A1 * | 6/2008 | Lai et al. | 430/109.3 |
| 2009/0061342 | A1 * | 3/2009 | Lai et al. | 430/105 |
| 2011/0097664 | A1 * | 4/2011 | Nosella et al. | 430/137.14 |
| 2011/0097665 | A1 * | 4/2011 | Nosella et al. | 430/137.14 |
| 2011/0136058 | A1 * | 6/2011 | Nosella et al. | 430/137.14 |
| 2011/0269065 | A1 * | 11/2011 | Vanbesien et al. | 430/108.11 |

* cited by examiner

*Primary Examiner* — Mark F Huff
*Assistant Examiner* — Rachel Zhang
(74) *Attorney, Agent, or Firm* — Eugene O. Palazzo

(57) ABSTRACT

The present disclosure provides processes for preparing toner particles, in which fewer coarse particles are generated. The process includes introducing a buffer solution during coalescence of the toner slurry. The amount of coarse particles in the resulting toner particles may, in embodiments, be reduced to less than about 5 percent by weight of the total toner particles generated.

18 Claims, No Drawings

TONER PROCESS

RELATED APPLICATIONS

This application is a continuation in part of co-pending U.S. patent application Ser. No. 12/056,337, filed on Mar. 27, 2008, the disclosure of which is hereby incorporated by reference in its entirety.

BACKGROUND

The present disclosure relates to toners suitable for electrophotographic apparatuses and processes for making such toners.

Numerous processes are within the purview of those skilled in the art for the preparation of toners. Emulsion aggregation (EA) is one such method. These toners may be formed by aggregating a colorant with a latex polymer formed by emulsion polymerization. For example, U.S. Pat. No. 5,853,943, the disclosure of which is hereby incorporated by reference in its entirety, is directed to a semi-continuous emulsion polymerization process for preparing latex by first forming a seed polymer. Other examples of emulsion/aggregation/coalescing processes for the preparation of toners are illustrated in U.S. Pat. Nos. 5,403,693, 5,418,108, 5,364,729, and 5,346,797, the disclosures of each of which are hereby incorporated by reference in their entirety. Other processes are disclosed in U.S. Pat. Nos. 5,527,658, 5,585,215, 5,650,255, 5,650,256 and 5,501,935, the disclosures of each of which are hereby incorporated by reference in their entirety.

Polyester EA ultra low melt (ULM) toners have been prepared utilizing amorphous and crystalline polyester resins. Some of these toners may have poor charging characteristics, which may be due, in part, to the presence of coarse particles. For example, while a circularity of greater than or equal to about 0.96 may be desirable, in embodiments the processes utilized to achieve this circularity, which may include heating the particles at a temperature below the melting point of the crystalline resin (in embodiments less than about 70° C.), may result in the formation of toners having a large number of undesired coarse particles, in some cases coarse particles may be present in an amount of from about 10% to about 15% by weight of the toner particles. Improved toners and processes for producing these toners thus remain desirable.

SUMMARY

The present disclosure provides toners and processes for producing such toners. In embodiments, a process of the present disclosure may include aggregating a latex emulsion including a resin such as poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), and poly(styrene-butyl acrylate-acrylonitrile-acrylic acid), and combinations thereof, with at least one stabilizer of the following formula

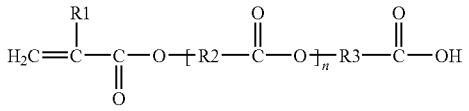

(I)

where R1 is hydrogen or a methyl group, R2 and R3 are independently alkyl groups containing from about 1 to about 12 carbon atoms or a phenyl group, and n is from about 0 to about 20, with an optional colorant, at least one surfactant, and an optional wax to form small particles. A buffer system is then added to the small particles, the buffer system having a pH of from about 3 to about 7; the aggregated particles are coalesced to form toner particles; and the toner particles are recovered, wherein less than about 4% of the toner particles generated have a diameter greater than about 25 microns.

In other embodiments, a process of the present disclosure may include aggregating a latex emulsion including a resin such as poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), and poly(styrene-butyl acrylate-acrylonitrile-acrylic acid), and combinations thereof, with at least one stabilizer of the following formula

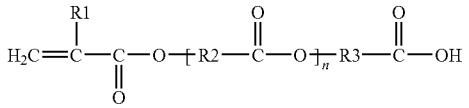

(I)

where R1 is hydrogen or a methyl group, R2 and R3 are independently alkyl groups containing from about 1 to about 12 carbon atoms or a phenyl group, and n is from about 0 to about 20, with an optional colorant, at least one surfactant, and an optional wax to form small particles; adding to the small particles a buffer system comprising an acid, a salt, and deionized water; coalescing the aggregated particles to form toner particles; and recovering the toner particles, wherein from about 0.1% to about 4% of the toner particles generated have a diameter greater than about 25 microns.

In other embodiments, a process of the present disclosure includes aggregating at least one resin such as poly(styrene-acrylate) resins, crosslinked poly(styrene-acrylate) resins, poly(styrene-methacrylate) resins, crosslinked poly(styrene-methacrylate) resins, poly(styrene-butadiene) resins, crosslinked poly(styrene-butadiene) resins, polyester resins, alkali sulfonated-polyester resins, polyimide resins, and combinations thereof, with at least one stabilizer such as beta carboxyethyl acrylate, poly(2-carboxyethyl)acrylate, 2-carboxyethyl methacrylate, and combinations thereof with an optional colorant, at least one surfactant, and an optional wax to form small particles; adding to the small particles a buffer system including acetic acid, sodium acetate, and deionized water; coalescing the small particles to form toner particles; and recovering the toner particles, wherein the buffer system has a pH of from about 4 to about 6, and wherein from about 1% to about 3% of the toner particles generated have a diameter greater than about 25 microns.

DETAILED DESCRIPTION

In embodiments of the present disclosure, toner particles may be prepared utilizing chemical processes which involve the aggregation and fusion of a latex resin with a colorant, an optional wax and other optional additives. The toner particles thus produced may form toner sized aggregates. The aggregation may be followed by coalescence or fusion by heating the resulting aggregates to form toner particles. During coalescence, a buffer system of the present disclosure may be added to the toner slurry to reduce the pH. The toner particles thus produced have a high circularity, in embodiments greater than or equal to about 0.96. At the same time, the number of coarse particles produced may be reduced. In embodiments the amount of coarse particles in the toner may be less than about 4% by weight of the total toner particles generated. As used herein a "coarse particle" includes, in embodiments, for example, particles having a diameter greater than about 25 microns, in embodiments from about 25 microns to about 1000 microns, in other embodiments from about 30 microns to about 500 microns.

Core Resins

Any latex resin may be utilized in forming a toner core of the present disclosure. Such resins, in turn, may be made of any suitable monomer. Suitable monomers useful in forming the resin include, but are not limited to, styrenes, acrylates, methacrylates, butadienes, isoprenes, acrylic acids, methacrylic acids, acrylonitriles, diol, diacid, diamine, diester, mixtures thereof, and the like. Any monomer employed may be selected depending upon the particular polymer to be utilized.

In embodiments, the polymer utilized to form the resin core may be a polyester resin, including the resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety.

In embodiments, the resin may be a polyester resin formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, ethylene glycol, combinations thereof, and the like. The aliphatic diol may be, for example, selected in an amount of from about 40 to about 60 mole percent, in embodiments from about 42 to about 55 mole percent, in embodiments from about 45 to about 53 mole percent, and the alkali sulfo-aliphatic diol can be selected in an amount of from about 0 to about 10 mole percent, in embodiments from about 1 to about 4 mole percent of the resin.

Examples of organic diacids or diesters selected for the preparation of the crystalline resins include oxalic acid, succinic acid, glutaric acid, adipic acid, suberic acid, azelaic acid, fumaric acid, maleic acid, dodecanedioic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof, and combinations thereof. The organic diacid may be selected in an amount of, for example, in embodiments from about 40 to about 60 mole percent, in embodiments from about 42 to about 55 mole percent, in embodiments from about 45 to about 53 mole percent.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), poly(decylene-sebacate), pol(decylene-decanoate), poly-(ethylene-decanoate), poly-(ethylene-dodecanoate), poyl(nonylene-sebacate), poly(nonylene-decanoate), copoly(ethylene-fumarate)-copyly(ethylene-sebacate), copoly(ethylene-fumarate)-copyly(ethylene-decanoate), and copoly (ethylene-fumarate)-copyly(ethylene-dodecanoate). The crystalline resin may be present, for example, in an amount of from about 5 to about 50 percent by weight of the toner components, in embodiments from about 10 to about 35 percent by weight of the toner components. The crystalline resin can possess various melting points of, for example, from about 30° C. to about 120° C., in embodiments from about 50° C. to about 90° C. The crystalline resin may have a number average molecular weight ($M_n$), as measured by gel permeation chromatography (GPC) of, for example, from about 1,000 to about 50,000, in embodiments from about 2,000 to about 25,000, and a weight average molecular weight ($M_w$) of, for example, from about 2,000 to about 100,000, in embodiments from about 3,000 to about 80,000, as determined by Gel Permeation Chromatography using polystyrene standards. The molecular weight distribution ($M_w/M_n$) of the crystalline resin may be, for example, from about 2 to about 6, in embodiments from about 3 to about 4.

Examples of diacid or diesters selected for the preparation of amorphous polyesters include dicarboxylic acids or diesters such as terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 55 mole percent of the resin, in embodiments from about 45 to about 53 mole percent of the resin.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis (2-hydroxyethyl) oxide, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin.

Polycondensation catalysts which may be utilized for either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin.

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include poly(styrene-acrylate) resins, crosslinked, for example, from about 10 percent to about 70 percent, poly(styrene-acrylate) resins, poly(styrene-methacrylate) resins, crosslinked poly(styrene-methacrylate) resins, poly(styrene-butadiene) resins, crosslinked poly(styrene-butadiene) resins, alkali sulfonated-polyester resins, branched alkali sulfonated-polyester resins, alkali sulfonated-polyimide resins, branched alkali sulfonated-polyimide resins, alkali sulfonated poly(styrene-acrylate) resins, crosslinked alkali sulfonated poly(styrene-acrylate) resins, poly(styrene-methacrylate) resins, crosslinked alkali sulfonated-poly(styrene-methacrylate) resins, alkali sulfonated-poly(styrene-butadiene) resins, and crosslinked alkali sulfonated poly(styrene-butadiene) resins. Alkali sulfonated polyester resins may be useful in embodiments, such as the metal or alkali salts of copoly(ethylene-terephthalate)-copoly (ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfoisophthalate), copoly (propylene-butylene-terephthalate)-copoly(propylene-butylene-5-sulfo-isophthalate), and copoly(propoxylated bisphenol-A-fumarate)-copoly(propoxylated bisphenol A-5-sulfo-isophthalate).

Examples of other suitable latex resins or polymers which may be utilized include, but are not limited to, poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly (ethyl acrylate-butadiene), poly(propyl acrylate-butadiene), poly(butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), and poly(styrene-butyl acrylate-acrylonitrile-acrylic acid), and combinations thereof. The polymers may be block, random, or alternating copolymers.

In embodiments, it may be advantageous to include a stabilizer when forming the latex resin. Suitable stabilizers include monomers having carboxylic acid functionality. In embodiments, suitable stabilizers may be of the following formula (I):

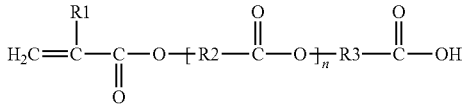

(I)

where R1 is hydrogen or a methyl group; R2 and R3 are independently selected from alkyl groups containing from about 1 to about 12 carbon atoms or a phenyl group; and n is from about 0 to about 20, in embodiments from about 1 to about 10. Examples of such stabilizers include beta carboxyethyl acrylate (sometimes referred to herein as poly(2-carboxyethyl)acrylate) (β-CEA), poly(2-carboxyethyl)acrylate, 2-carboxyethyl methacrylate, combinations thereof, and the like.

In embodiments, the stabilizer having carboxylic acid functionality may also contain metallic ions, such as sodium, potassium and/or calcium, to achieve better emulsion polymerization results. The metallic ions may be present in an amount from about 0.001 to about 10 percent by weight of the stabilizer having carboxylic acid functionality, in embodiments from about 0.5 to about 5 percent by weight of the stabilizer having carboxylic acid functionality.

It may be desirable, in embodiments, to include an acrylate such as a beta-carboxyethyl acrylate (β-CEA) in forming the latex. Thus, in embodiments, a poly(styrene-butyl acrylate-beta-carboxyethyl acrylate) may be utilized as the latex. The glass transition temperature of this latex may be from about 45° C. to about 65° C., in embodiments from about 48° C. to about 62° C.

In other embodiments, an unsaturated polyester resin may be utilized as a latex resin. Examples of such resins include those disclosed in U.S. Pat. No. 6,063,827, the disclosure of which is hereby incorporated by reference in its entirety. Exemplary unsaturated polyester resins include, but are not limited to, poly(propoxylated bisphenol co-fumarate), poly (ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly (ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly (ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

In embodiments, a suitable amorphous polyester resin may be a poly(propoxylated bisphenol A co-fumarate) resin having the following formula (I):

(I)

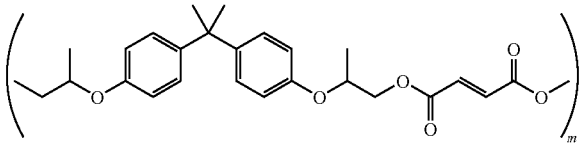

wherein m may be from about 5 to about 1000.

An example of a linear propoxylated bisphenol A fumarate resin which may be utilized as a latex resin is available under the trade name SPARII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, North Carolina and the like.

Suitable crystalline resins include those disclosed in U.S. Patent Application Publication No. 2006/0222991, the disclosure of which is hereby incorporated by reference in its entirety. In embodiments, a suitable crystalline resin may be composed of ethylene glycol and a mixture of dodecanedioic acid and fumaric acid co-monomers with the following formula:

(II)

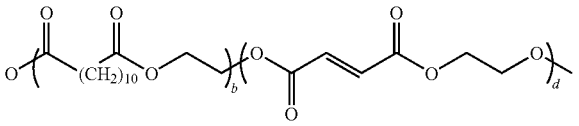

wherein b is from 5 to 2000 and d is from 5 to 2000.

One, two, or more toner resins may be used. In embodiments where two or more toner resins are used, the toner resins may be in any suitable ratio (e.g., weight ratio) such as for instance about 10% first resin/90% second resin to about 90% first resin/10% second resin. In embodiments, the amorphous resin utilized in the core may be linear.

In embodiments, the resin may be formed by emulsion polymerization methods. In other embodiments, a pre-made resin may be utilized to form the toner.

The resin described above may be utilized to form toner compositions. Such toner compositions may include optional colorants, waxes, and other additives. Toners may be formed utilizing any method within the purview of those skilled in the art.

Surfactants

In embodiments, colorants, waxes, and other additives utilized to form toner compositions may be in dispersions including surfactants. Moreover, toner particles may be formed by emulsion aggregation methods where the resin and other components of the toner are placed in one or more surfactants, an emulsion is formed, toner particles are aggregated, coalesced, optionally washed and dried, and recovered.

One, two, or more surfactants may be utilized. The surfactants may be selected from ionic surfactants and nonionic surfactants. Anionic surfactants and cationic surfactants are encompassed by the term "ionic surfactants." In embodiments, the surfactant may be utilized so that it is present in an amount of from about 0.01% to about 5% by weight of the toner composition, for example from about 0.75% to about 4% by weight of the toner composition, in embodiments from about 1% to about 3% by weight of the toner composition.

Examples of nonionic surfactants that can be utilized include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. Other examples of suitable nonionic surfactants include a block copolymer of polyethylene oxide and polypropylene oxide, including those commercially available as SYNPERONIC PE/F, in embodiments SYNPERONIC PE/F 108.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Colorants

As the optional colorant to be added, various known suitable colorants, such as dyes, pigments, mixtures of dyes, mixtures of pigments, mixtures of dyes and pigments, and the like, may be included in the toner. The colorant may be included in the toner in an amount of, for example, about 0.1 to about 35 percent by weight of the toner, or from about 1 to about 15 weight percent of the toner, or from about 3 to about 10 percent by weight of the toner.

As examples of suitable colorants, mention may be made of carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

Specific examples of pigments include SUNSPERSE 6000, FLEXIVERSE and AQUATONE water based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI-60710, CI Dispersed Red 15, diazo dye identified in the Color Index as CI-26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, and Anthrathrene Blue, identified in the Color Index as CI-69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing, and the like.

Wax

Optionally, a wax may also be combined with the resin and an optional colorant in forming toner particles. When included, the wax may be present in an amount of, for example, from about 1 weight percent to about 25 weight percent of the toner particles, in embodiments from about 5 weight percent to about 20 weight percent of the toner particles.

Waxes that may be selected include waxes having, for example, a weight average molecular weight of from about 500 to about 20,000, in embodiments from about 1,000 to about 10,000. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents.

Toner Preparation

The toner particles may be prepared by any method within the purview of one skilled in the art. Although embodiments relating to toner particle production are described below with respect to emulsion-aggregation processes, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner-particle shape and morphology.

In embodiments, toner compositions may be prepared by emulsion-aggregation processes, such as a process that includes aggregating a mixture of an optional colorant, an optional wax and any other desired or required additives, and emulsions including the resins described above, optionally in surfactants as described above, and then coalescing the aggregate mixture. A mixture may be prepared by adding a colorant and optionally a wax or other materials, which may also be optionally in a dispersion(s) including a surfactant, to the emulsion, which may be a mixture of two or more emulsions containing the resin. The pH of the resulting mixture may be adjusted by an acid such as, for example, acetic acid, nitric acid or the like. In embodiments, the pH of the mixture may be adjusted to from about 2 to about 5. Additionally, in embodiments, the mixture may be homogenized. If the mixture is homogenized, homogenization may be accomplished by mixing at about 600 to about 4,000 revolutions per minute. Homogenization may be accomplished by any suitable means, including, for example, an IKA ULTRA TURRAX T50 probe homogenizer.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

The aggregating agent may be added to the mixture utilized to form a toner in an amount of, for example, from about 0.1% to about 8% by weight, in embodiments from about 0.2% to about 5% by weight, in other embodiments from about 0.5% to about 5% by weight, of the resin in the mixture. This provides a sufficient amount of agent for aggregation.

In order to control aggregation and coalescence of the particles, in embodiments the aggregating agent may be metered into the mixture over time. For example, the agent may be metered into the mixture over a period of from about 5 to about 240 minutes, in embodiments from about 30 to about 200 minutes, although more or less time may be used as desired or required. The addition of the agent may also be done while the mixture is maintained under stirred conditions, in embodiments from about 50 rpm to about 1,000 rpm, in other embodiments from about 100 rpm to about 500 rpm, and at a temperature that is below the glass transition temperature of the resin as discussed above, in embodiments from about 30° C. to about 90° C., in embodiments from about 35° C. to about 70° C.

The particles may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for average particle size. The aggregation thus may proceed by maintaining the elevated temperature, or slowly raising the temperature to, for example, from about 40° C. to about 100° C., and holding the mixture at this temperature for a time from about 0.5 hours to about 6 hours, in embodiments from about hour 1 to about 5 hours, while maintaining stirring, to provide the aggregated particles. Once the predetermined desired particle size is reached, then the growth process is halted. In embodiments, the predetermined desired particle size is within the toner particle size ranges mentioned above.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example of from about 40° C. to about 90° C., in embodiments from about 45° C. to about 80° C., which may be below the glass transition temperature of the resin as discussed above.

Shell Resin

A shell may then be applied to the formed aggregated toner particles. Any resin described above as suitable for the core resin may be utilized as the shell resin. The shell resin may be applied to the aggregated particles by any method within the purview of those skilled in the art. In embodiments, the shell resin may be in an emulsion including any surfactant described above. The aggregated particles described above may be combined with said emulsion so that the resin forms a shell over the formed aggregates. In embodiments, an amorphous polyester may be utilized to form a shell over the aggregates to form toner particles having a core-shell configuration.

Once the desired final size of the toner particles is achieved, the pH of the mixture may be adjusted with a base to a value of from about 6 to about 10, and in embodiments from about 6.2 to about 7. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) may be added to help adjust the pH to the desired values noted above. The base may be added in amounts from about 2 to about 25 percent by weight of the mixture, in embodiments from about 4 to about 10 percent by weight of the mixture.

Coalescence

Following aggregation to the desired particle size, with the formation of an optional shell as described above, the particles may then be coalesced to the desired final shape, the coalescence being achieved by, for example, heating the mixture to a temperature of from about 55° C. to about 100° C., in embodiments from about 65° C. to about 75° C., in embodiments about 70° C., which may be below the melting point of the crystalline resin to prevent plasticization. Higher or lower temperatures may be used, it being understood that the temperature is a function of the resins used for the binder.

Buffer System

As noted above, acids may be added during aggregation of the toner particles. Without wishing to be bound by any theory, the localized low pH which occurs during the acid addition which may assist in aggregation, may also result in the generation of coarse particles. Diluting an acid such as nitric acid during aggregation, which may help minimize some coarse particle generation, may not be practical for large scale production as it would adversely affect toner throughput.

Thus, in accordance with the present disclosure, a buffer system may be added to the toner slurry during coalescence to minimize or avoid the generation of coarse toner particles. In embodiments, the buffer system may include acids, salts, and combinations thereof.

Suitable acids which may be utilized to form the buffer system include, but are not limited to, aliphatic acids and/or aromatic acids such as acetic acid, citric acid, formic acid, oxalic acid, phthalic acid, salicylic acid, combinations thereof, and the like. Suitable salts which may be utilized to form the buffer system include, but are not limited to, metallic salts of aliphatic acids or aromatic acids, such as sodium acetate, sodium acetate trihydrate, potassium acetate, zinc acetate, sodium hydrogen phosphate, potassium formate, sodium oxalate, sodium phthalate, potassium salicylate, combinations thereof, and the like.

In embodiments, a suitable buffer system may include a combination of acids and salts. For example, in embodiments, a buffer system may include sodium acetate and acetic acid.

In embodiments, a buffer system of the present disclosure may be in a solution with deionized water as the solvent.

The amount of acid and salts utilized in forming the buffer system, as well as deionized water utilized in forming a buffer solution, may vary depending upon the acid used, the salt used, and the composition of the toner particles. As noted above, in embodiments a buffer system may include both an acid and a salt. In such a case, the amount of acid in the buffer system may be from about 1% by weight to about 40% by weight of the buffer system, in embodiments from about 2% by weight to about 30% by weight of the buffer system. The amount of salt in the buffer system may be from about 10% by weight to about 50% by weight of the buffer system, in embodiments from about 30% by weight of the buffer system to about 40% by weight of the buffer system.

The amount of acid and/or salt in the buffer system may be in amounts so that the pH of the buffer system is from about 3 to about 7, in embodiments from about 4 to about 6. The buffer system may be added to the toner slurry as described above so that the pH of the toner slurry is from about 4 to about 7, in embodiments from about 5.8 to about 6.5.

Coalescence may then proceed and be accomplished over a period of from about 0.1 to about 9 hours, in embodiments from about 0.5 to about 4 hours.

In accordance with the present disclosure, it has been found that by utilizing a buffer system as described herein, the amount of coarse particles generated during formation of the toner particles may be reduced. Thus, in embodiments, the use of a buffer system of the present disclosure may result in less than about 4% of the toner particles generated having a diameter greater than about 25 microns, in embodiments from about 0.1% to about 4% of the toner particles generated having a diameter greater than about 25 microns, in other embodiments from about 1% to about 3% of the toner particles generated having a diameter greater than about 25 microns.

After coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles may be optionally washed with water, and then dried. Drying may be accomplished by any suitable method for drying including, for example, freeze-drying.

Additives

In embodiments, the toner particles may also contain other optional additives, as desired or required. For example, the toner may include positive or negative charge control agents, for example in an amount of from about 0.1 to about 10 percent by weight of the toner, in embodiments from about 1 to about 3 percent by weight of the toner. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in its entirety; organic sulfate and sulfonate compositions, including those disclosed in U.S. Pat. No. 4,338,390, the disclosure of which is hereby incorporated by reference in its entirety; cetyl pyridinium tetrafluoroborates; distearyl dimethyl ammonium methyl sulfate; aluminum salts such as BONTRON E84™ or E88™ (Hodogaya Chemical); combinations thereof, and the like. Such charge control agents may be applied simultaneously with the shell resin described above or after application of the shell resin.

There can also be blended with the toner particles external additive particles including flow aid additives, which additives may be present on the surface of the toner particles. Examples of these additives include metal oxides such as titanium oxide, silicon oxide, tin oxide, mixtures thereof, and the like; colloidal and amorphous silicas, such as AEROSIL®, metal salts and metal salts of fatty acids inclusive of zinc stearate, aluminum oxides, cerium oxides, and mixtures thereof. Each of these external additives may be present in an amount of from about 0.1 percent by weight to about 5 percent by weight of the toner, in embodiments of from about 0.25 percent by weight to about 3 percent by weight of the toner. Suitable additives include those disclosed in U.S. Pat. Nos. 3,590,000, 3,800,588, and 6,214,507, the disclosures of each of which are hereby incorporated by reference in their entirety. Again, these additives may be applied simultaneously with the shell resin described above or after application of the shell resin.

In embodiments, toners of the present disclosure may be utilized as ultra low melt (ULM) toners. In embodiments, the dry toner particles, exclusive of external surface additives, may have the following characteristics:

(1) Volume average diameter (also referred to as "volume average particle diameter") of from about 3 to about 20 μm, in embodiments from about 4 to about 15 μm, in other embodiments from about 5 to about 9 μm.

(2) Number Average Geometric Standard Deviation (GSDn) and/or Volume Average Geometric Standard Deviation (GSDv) of from about 1.05 to about 1.55, in embodiments from about 1.1 to about 1.4.

(3) Circularity of from about 0.9 to about 1 (measured with, for example, a Sysmex FPIA 2100 analyzer), in embodiments form about 0.95 to about 0.985, in other embodiments from about 0.96 to about 0.98.

(4) Glass transition temperature of from about 40° C. to about 65° C., in embodiments from about 55° C. to about 62° C.

The characteristics of the toner particles may be determined by any suitable technique and apparatus. Volume average particle diameter $D_{50v}$, GSDv, and GSDn may be measured by means of a measuring instrument such as a Beckman Coulter Multisizer 3, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter Multisizer 3. Toners produced in accordance with the present disclosure may possess excellent charging characteristics when exposed to extreme relative humidity (RH) conditions. The low-humidity zone (C zone) may be about 10° C./15% RH, while the high humidity zone (A zone) may be about 28° C./85% RH. Toners of the present disclosure may also possess a parent toner charge per mass ratio (Q/M) of from about −3 μC/g to about −35 μC/g, and a final toner charging after surface additive blending of from −10 μC/g to about −45 μC/g.

In accordance with the present disclosure, the charging of the toner particles may be enhanced, so less surface additives may be required, and the final toner charging may thus be higher to meet machine charging requirements.

Developers

The toner particles may be formulated into a developer composition. The toner particles may be mixed with carrier particles to achieve a two-component developer composition. The toner concentration in the developer may be from about 1% to about 25% by weight of the total weight of the developer, in embodiments from about 2% to about 15% by weight of the total weight of the developer.

Carriers

Examples of carrier particles that can be utilized for mixing with the toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Other carriers include those disclosed in U.S. Pat. Nos. 3,847,604, 4,937,166, and 4,935,326.

The selected carrier particles can be used with or without a coating. In embodiments, the carrier particles may include a core with a coating thereover which may be formed from a mixture of polymers that are not in close proximity thereto in the triboelectric series. The coating may include fluoropolymers, such as polyvinylidene fluoride resins, terpolymers of styrene, methyl methacrylate, and/or silanes, such as triethoxy silane, tetrafluoroethylenes, other known coatings and the like. For example, coatings containing polyvinylidenefluoride, available, for example, as KYNAR 301F™, and/or polymethylmethacrylate, for example having a weight average molecular weight of about 300,000 to about 350,000, such as commercially available from Soken, may be used. In embodiments, polyvinylidenefluoride and polymethylmethacrylate (PMMA) may be mixed in proportions of from about 30 to about 70 weight % to about 70 to about 30 weight %, in embodiments from about 40 to about 60 weight % to about 60 to about 40 weight %. The coating may have a coating weight of, for example, from about 0.1 to about 5% by weight of the carrier, in embodiments from about 0.5 to about 2% by weight of the carrier.

In embodiments, PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with polymer in an amount from about 0.05 to about 10 percent by weight, in embodiments from about 0.01 percent to about 3 percent by weight, based on the weight of the coated carrier particles, until adherence thereof to the carrier core by mechanical impaction and/or electrostatic attraction.

Various effective suitable means can be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof, and the like. The mixture of carrier core particles and polymer may then be heated to enable the polymer to melt and fuse to the carrier core particles. The coated carrier particles may then be cooled and thereafter classified to a desired particle size.

In embodiments, suitable carriers may include a steel core, for example of from about 25 to about 100 μm in size, in embodiments from about 50 to about 75 μm in size, coated with about 0.5% to about 10% by weight, in embodiments from about 0.7% to about 5% by weight, of a conductive polymer mixture including, for example, methylacrylate and carbon black using the process described in U.S. Pat. Nos. 5,236,629 and 5,330,874.

The carrier particles can be mixed with the toner particles in various suitable combinations. The concentrations are may be from about 1% to about 20% by weight of the toner composition. However, different toner and carrier percentages may be used to achieve a developer composition with desired characteristics.

Imaging

The toners can be utilized for electrophotographic processes, including those disclosed in U.S. Pat. No. 4,295,990, the disclosure of which is hereby incorporated by reference in its entirety. In embodiments, any known type of image development system may be used in an image developing device, including, for example, magnetic brush development, jumping single-component development, hybrid scavengeless development (HSD), and the like. These and similar development systems are within the purview of those skilled in the art.

Imaging processes include, for example, preparing an image with an electrophotographic device including a charging component, an imaging component, a photoconductive component, a developing component, a transfer component, and a fusing component. In embodiments, the development component may include a developer prepared by mixing a carrier with a toner composition described herein. The electrophotographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. In embodiments, the toners may be used in developing an image in an image-developing device utilizing a fuser roll member. Fuser roll members are contact fusing devices that are within the purview of those skilled in the art, in which heat and pressure from the roll may be used to fuse the toner to the image-receiving medium. In embodiments, the fuser member may be heated to a temperature above the fusing temperature of the toner, for example to temperatures of from about 70° C. to about 160° C., in embodiments from about 80° C. to about 150° C., in other embodiments from about 90° C. to about 140° C., after or during melting onto the image receiving substrate.

In embodiments where the toner resin is crosslinkable, such crosslinking may be accomplished in any suitable manner. For example, the toner resin may be crosslinked during fusing of the toner to the substrate where the toner resin is crosslinkable at the fusing temperature. Crosslinking also may be effected by heating the fused image to a temperature at which the toner resin will be crosslinked, for example in a post-fusing operation. In embodiments, crosslinking may be effected at temperatures of from about 160° C. or less, in embodiments from about 70° C. to about 160° C., in other embodiments from about 80° C. to about 140° C.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

EXAMPLES

Example 1

About 40.8 grams of sodium acetate trihydrate (NaAc) was added to about 70 ml of deionized water, and the pH was adjusted to about 6 by the addition of glacial acetic acid. Additional deionized water was then added to produce a solution having a volume of about 100 ml, and the pH was adjusted as necessary to a pH of about 6. The resulting 100 ml buffer solution had a concentration of about 3 M NaAc.

Example 2

A cyan polyester emulsion aggregation ultra low melt (EA ULM) toner was prepared as follows. About 155.7 grams of a linear amorphous resin in an emulsion (about 48.5 weight % resin), was charged to a 2 Liter plastic beaker. The linear amorphous resin was of the following formula:

(I)

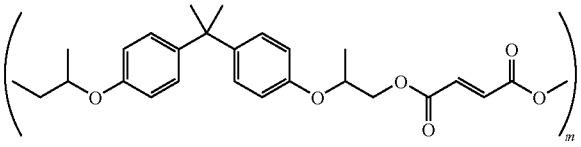

wherein m was from about 5 to about 1000. Also charged was about 132.8 grams of an unsaturated crystalline polyester ("UCPE") resin, copoly(ethylene-fumarate)-copyly(ethylene-dodecanoate), derived from ethylene glycol and a mixture of dodecanedioic acid and fumaric acid co-monomers with the following formula:

(II)

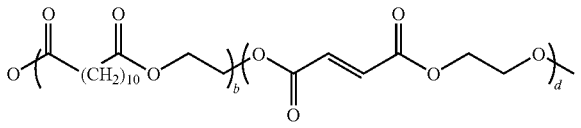

wherein b is from 5 to 2000 and d is from 5 to 2000 in an emulsion (about 12.14 weight % resin), and about 32.4 grams of a cyan pigment dispersion, which was Pigment Blue 15:3 (about 17 weight %) was added to the beaker. About 1.45 grams of $Al_2(SO_4)_3$ mixed with 13 grams of nitric acid (about 0.02M) was added and homogenized by mixing the mixture at about 3000-4000 rpm for about 10 minutes. The slurry was then poured into a 2 L Buchi reactor.

The mixture was then aggregated at a batch temperature of about 45° C. During aggregation, a shell was added to obtain particles having a target particle size of about 8.5. The shell included about 77.6 grams of the same amorphous resin in emulsion as above, 1.6 grams of Dowfax 2A1 and 166 grams of deionized water, all pH adjusted to 3.2 with 14 grams of nitric acid (about 0.3M). The aggregation was stopped by adjusting the pH to about 6.6 using sodium hydroxide and then 0.93 grams of tetrasodium ethylenediamine tetraacetate (VERSENE™ 100 (from Dow Chemical)) mixed with about 13 grams of deionized water. The process proceeded as the reactor temperature (Tr) was increased to about 70° C. while maintaining the toner slurry at a pH greater than or equal to about 6.5 until the Tr was about 60° C.

The particles were then coalesced as follows. Once the Tr reached about 70° C., the pH of the toner slurry was determined to be about 6.43. The GSDv of the particles in the slurry was obtained by Beckman Coulter Multisizer 3. About 18.73 grams of the buffer solution produced in Example 1 above (concentration of 3 M NaAc) was then added to the toner slurry until the pH of the toner slurry was about 6.1. After about 30 minutes, the target circularity of greater than 0.970 was achieved, as determined by Sysmex FPIA 2100 Analyzer. The GSDv of the particles was then obtained as described above, as was volume median diameter (D50), circularity, and % coarseness of the particles.

Comparative Example 1

The same cyan toner described above in Example 2 was prepared, except in this Example nitric acid (about 0.3 M) was utilized to coalesce the toner particles instead of the buffer solution of Example 1. The particles were synthesized and aggregated as described above in Example 2. For coalescence, once the Tr reached about 70° C., the pH of the toner slurry was determined to be about 6.38. The GSDv of the particles in the slurry was determined as described above in Example 2. About 9.04 grams of 0.3M Nitric acid was then added to the mixture until the toner slurry reached a pH of about 6.1. After about 30 minutes, the target circularity of greater than 0.970 was achieved, as determined by Sysmex FPIA 2100 Analyzer. The GSDv of the particles was then obtained as described above, as was volume median diameter (D50), circularity, and % coarseness of the particles.

The properties of the toner particles produced with the acid (in this Comparative Example 1) and the buffer system of the present disclosure (Example 2) are summarized in Tables 1 and 2 below:

TABLE 1

| | Comparative Example 1 | | Example 2 | |
|---|---|---|---|---|
| | Before Acid | After Acid | Before Buffer | After Buffer |
| Upper Vol. GSD (D84/D50) | 1.1947 | 1.2072 | 1.2457 | 1.2328 |
| % Coarse(>16 microns) | 0.04 | 0.52 | 0.40 | 0.23 |

TABLE 2

| | Comparative Example 1 | Example 2 |
|---|---|---|
| Vol. Median Diameter (D50) | 7.90 microns | 8.87 microns |
| Upper Vol. GSD (D84/D50) | 1.1947 | 1.2328 |
| Lower Vol. GSD (D50/D16) | 1.2457 | 1.2457 |
| % Coarse (>16 microns) | 0.73 | 0.14 |
| % Coarse (>25 microns) | 8.7 | 2.6 |
| Circularity | 0.977 | 0.974 |

As can be seen from Table 1, as the coarseness of the particles increased, the GSDv similarly increased, with both values greater for the toner produced with the acid of Comparative Example 1 than the toner produced with the buffer system of the present disclosure as in Example 2.

Comparative Example 2

A yellow styrene acrylate high gloss toner was prepared at a 2 liter bench scale (about 165 grams dry theoretical toner). The core toner slurry included about 221.4 grains of 42% solids of a styrene-acrylate latex, produced by emulsion polymerization (glass transition temperature (Tg) 51° C.+/−2° C.), with about 511.8 grams of deionized water, about 59.4 grams of polyethylene wax (commercially available from IGI) (about 31.3% solids) and about 54 grams of yellow pigment (Y74 from Sun Chemical Inc., about 20% solids), that were mixed together in a 2 liter plastic beaker. The slurry was then homogenized for a total of about 10 minutes with mixing at from about 3000 to about 4000 revolutions per minute (rpm) while adding in a coagulant solution, which included about 2.97 grams polyaluminum chloride and about 26.73 grams of about 0.02M nitric acid.

The toner slurry was then transferred to a 2 liter Buchi reactor and heated to begin aggregation. The toner slurry was aggregated at a temperature of about 52° C. During aggregation, the toner particle size was closely monitored. At about 4.3 micron size, a shell including about 111.5 grams of about 41.4% solids of a styrene acrylate latex, produced by emulsion polymerization (Tg 59° C.+/−2° C.), similar to that used in the core, was added to achieve the final targeted particle size of about 5.3 microns. The pH was then adjusted to about 5 using about 23.2 grams of 4% sodium hydroxide (NaOH) to freeze, that is stop, the aggregation step. The process proceeded with the reactor temperature (Tr) increased to about 96° C. Once at 96° C., the pH of the toner slurry was reduced to about 4.6 with the addition of about 0.3M nitric acid and held until the circularity of the particles reached ≧0.950.

The final toner particles had a particle size (D50), particle distribution by volume, and circularity of about 5.20 microns, about 1.21 and about 0.957, respectively. The % coarse particles (>25 microns) was about 0.6.

Example 3

About 72 grams of citric acid was added to about 150 ml of deionized water, and the pH was adjusted to about 3 by the addition of sodium hydroxide (NaOH). Additional deionized water was then added to produce a solution having a volume of about 250 ml, and the pH was adjusted as necessary to a pH of about 3. The resulting 250 ml buffer solution had a concentration of about 1.5 M citric acid.

A yellow styrene acrylate high gloss toner was prepared similar to the one described in Comparative Example 2 at a 2 liter bench scale (again, about 165 grams dry theoretical toner). The components and amounts utilized to form the toner were the same as Comparative Example 2, except that about 14.8 grams of 4% Sodium Hydroxide (NaOH) was utilized to produce a pH of about 5 to freeze, that is stop, the aggregation step after addition of the shell. The process proceeded with the Tr increased to about 96° C. Once at about 96° C., the pH of the toner slurry was reduced to about 3.7 with the addition of a buffer in accordance with the present disclosure, which included about 7 grams of the 1.5 M citric acid-NaOH buffer having a pH of about 3, described above, and held until the circularity reached ≧0.950.

The final toner particles had a particle size (D50), particle distribution by volume, and circularity, of about 5.20 microns, about 1.23 and about 0.952, respectively. The % coarse particles (>25 microns) was about 0.4, which was lower than the % coarse particles found for Comparative Example 2, where the citric acid/NaOH buffer was not used.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A toner process consisting of: aggregating a latex emulsion containing a first resin selected from the group consisting of poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isopropene), poly(methyl methacrylate-isopropene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), polystyrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), polyesters, and poly(styrene-butyl acrylate-acrylonitrile-acrylic acid), and combinations thereof, with at least one stabilizer of the following formula

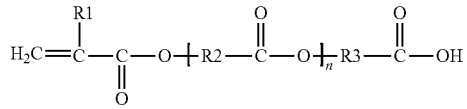

where $R^1$ is hydrogen or a methyl group, $R^2$ and $R^3$ are independently selected from alkyl groups containing from about 1 to about 12 carbon atoms or a phenyl group, and n is from about 0 to about 20, with a colorant, at least one surfactant, and an optional wax to form small particles; adding to the particles obtained a buffer system having a pH of from about 5 to about 6.5 and which buffer system consists of a mixture at an acid, a salt, and optionally deionized water, wherein the acid is selected from the group consisting of acetic acid, glacial acetic acid, citric acid, formic acid, oxalic acid, phthalic acid, salicylic acid, and mixtures thereof, and the salt is selected from the group consisting of sodium acetate, sodium acetate trihydrate, potassium acetate, zinc acetate, sodium hydrogen phosphate, potassium formate, sodium oxalate, sodium phthalate, potassium salicylate, and mixtures thereof; adding a second emulsion containing a second resin; coalescing the resulting aggregated particles to form toner particles; and recovering the toner particles, wherein less than about 4% of the toner particles generated have a diameter greater than about 25 microns, and wherein said toner consists of a core of at least one of said first resins and a shell of said second resin.

2. A process according to claim 1, wherein the at least one stabilizer is selected from the group consisting of beta carboxyethyl acrylate, poly(2-carboxyethyl) acrylate, 2-carboxyethyl methacrylate, and combinations thereof, and wherein said core consists of a polyester resin, said stabilizer, said colorant, said surfactant, said optional wax, and said deionized water and said shell second resin consists of an amorphous polyester resin.

3. A process according to claim 1, wherein the colorant is selected from the group consisting of dyes, pigments, combinations of dyes, combinations of pigments, and combinations of dyes and pigments, present in an amount of from about 0.1 to about 35 percent by weight of the toner and wherein said core consists of said first resin of an amorphous polyester resin, said stabilizer, said colorant, said surfactant, said optional wax, and said deionized water and said shell consists of said second resin of at least one of an amorphous polyester ream and a crystalline polyester resin.

4. A process according to claim 1, wherein the optional wax is selected from the group consisting of polyolefins, carnauba wax, rice wax, candelilla wax, sumacs wax, jojoba oil, beeswax, montan wax, ozokerite, ceresin, paraffin wax, microcrystalline wax, Fischer-Tropsch wax, stearyl stearate, behenyl behenate, butyl stearate, propyl oleate, glyceride monostearate, glyceride distearate, pentaerythritol tetra behenate, diethyleneglycol monostearate, dipropyleneglycol distearate, diglyceryl distearate, triglyceryl tetrastearate, sorbitan monostearate, cholesteryl stearate, and combinations thereof, present in an amount from about 1 weight percent to about 25 weight percent of the toner.

5. A process according to claim 1 wherein the acid is acetic acid, or glacial acetic acid.

6. A process according to claim 1 wherein the salt is sodium acetate trihydrate.

7. A process according to claim 1 wherein the deionized water is present.

8. A process according to claim 1, wherein the toner particles are of a size of from about 3 um to about 20 um, have a circularity of from about 0.9 to about 1, and possess a glass transition temperature of from about 40° C. to about 65° C.

9. A process according to claim 1, wherein the latex first resin consists of a poly(styrene-butyl acrylate-beta-carboxyethyl acrylate) possessing a glass transition temperature of from about 45° C. to about 65° C.

10. A process comprising: aggregating a latex emulsion comprising a first resin selected from the group consisting of poly(styrene-butadiene), poly(methylstyrene-butadiene), poly(methyl methacrylate-butadiene), poly(ethyl methacrylate-butadiene), poly(propyl methacrylate-butadiene), poly (methacrylate-butadiene), poly(methyl acylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), a polyester, poly(stryene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), and poly(styrene-butyl acrylate-acrylonitrile-acrylic acid), and combinations thereof, with a stabilizer of the following formula (I)

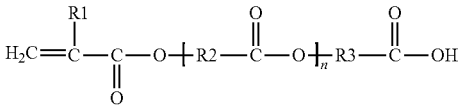

where R1 is hydrogen or a methyl group, R2 and R3 are independently selected from alkyl groups containing from about 1 to about 12 carbon atoms or a phenyl group, and n is from about 0 to about 20, with a colorant, at least one surfactant, and a wax to form small particles; adding to the small particles a buffer system having a pH of from about 5 to about 6.5 and which buffer system comprises an acid, a salt, and optionally deionized water, where said acid is selected from the group consisting of acetic acid, glacial acetic acid, citric acid, formic acid, oxalic acid, phthalic acid, salicylic acid, and mixtures thereof, and said salt is selected from the group consisting of sodium acetate, sodium acetate trihydrate, potassium acetate, zinc acetate, sodium hydrogen phosphate, potassium formate, sodium oxalate, sodium phthalate, potassium salicylate, and mixtures thereof; adding an emulsion containing a second resin; coalescing the aggregated particles to form toner particles; and recovering the toner particles, wherein from about 0.1% to about 4% of the toner particles generated have a diameter greater than about 25 microns.

11. A process according to claim 10, wherein the acid is selected from the group consisting of acetic acid, citric acid, formic acid, oxalic acid, phthalic acid, and salicylic acid and the salt is selected from the group consisting of sodium acetate, sedum acetate trihydrate, potassium acetate, zinc acetate, sodium hydrogen phosphate, potassium formate, sodium oxalate, sodium phthalate, and potassium salicylate, and wherein said toner comprises said first resin of a polyester in a core and said second resin of a polyester in a shell, said core and said shell being comprised of at least one of an amorphous polyester resin and a crystalline polyester.

12. A process according to claim 10, wherein the colorant is selected from the group consisting of dyes, pigments, combinations of dyes, combinations of pigments, and combinations of dyes and pigments, in an amount of from about 0.1 to about 35 percent by weight of the toner, and the wax is selected from the group consisting of polyolefins, carnauba wax, rice wax, candelilla wax, sumacs wax, jojoba oil, beeswax, montan wax, ozokerite, ceresin, paraffin wax, microcrystalline wax, Fischer-Tropsch wax, stearyl stearate, behenyl behenate, butyl stearate, propyl oleate, glyceride monostearate, glyceride distearate, pentaerythritol tetra behenate, diethyleneglycol monostearate, dipropyleneglycol distearate, diglyceryl distearate, triglyceryl tetrastearate, sorbitan monostearate, cholesteryl stearate, and combinations thereof, present in an amount from about 1 weight percent to about 25 weight percent of the toner.

13. A process according to claim 10, wherein the toner particles are of a size of from about 5 um to about 9 um, have a circularity of from about 0.95 to about 0.985, and possess a glass transition temperature of from about 55° C. to about 62° C. and wherein said toner comprises said first resin of a polyester in a core and said first resin of a polyester in a shell, said core and said shell being comprised of at least one of an amorphous polyester resin and a crystalline polyester resin.

14. A process according to claim 10, wherein the latex first resin comprises a poly(styrene-butyl acrylate-beta-carboxyethyl acrylate) possessing a glass transition temperature of from about 45° C. to about 65° C.

15. A process consisting of: aggregating a polyester resin with a stabilizer selected from the group consisting of beta carboxyethyl acrylate, poly(2-carboxyethyl)acrylate, and 2-carboxyethyl methacrylate, a colorant, a surfactant, and a wax adding to the particles generated a buffer system and which buffer system consists of a mixture of an acid, a salt, and deionized water, wherein the acid is selected from the group consisting of acetic acid, glacial acetic acid, citric acid, formic acid, oxalic acid, phthalic acid, salicylic acid, and mixtures thereof, and the salt is selected from the group consisting of sodium acetate, sodium acetate trihydrate, potassium acetate, zinc acetate, sodium hydrogen phosphate, potassium formate, sodium oxalate, sodium phthalate, potassium salicylate, and mixtures thereof; adding an emulsion containing a second resin; coalescing the resulting small particles to form toner particles; and recovering the toner particles, wherein the buffer system has a pH of from from about 5 to about 6.5, and wherein from about 1% to about 3% of the toner particles generated have a diameter greater than about 25 microns, and wherein said toner consists of said first resin of a polyester, said stabilizer, said colorant, said surfactant, said deionized water, and said wax in a core and said second resin of a polyester shell, said core and said shell consisting of at least one of an amorphous polyester and a crystalline polyester.

16. A process according to claim 15, wherein the colorant is selected from the group consisting of dyes, pigments, combinations of dyes, combinations of pigments, and combinations of dyes and pigments in an amount of from about 0.1 to about 35 percent by weight of the toner.

17. A process according to claim 15, wherein the wax is selected from the group consisting of polyolefins, carnauba wax, rice wax, candelillia wax, sumacs wax, jojoba, beeswax, montan wax, ozokerite, ceresin, paraffin wax, microcrystalline wax, Fischer-Tropsch wax, stearyl stearate, behenyl behenate, butyl stearate, propyl oleate, glyceride monostearate, glyceride distearate, pentaerythritol tetra behenate, diethyleneglycol monostearate, dipropyleneglycol distearate, diglyceryl distearate, triglyceryl tetrastearate, sorbitan monostearate, and cholesteryl stearate, present in an amount from about 1 weight percent to about 25 weight percent of the toner.

18. A process according to claim 15, wherein said core consists of a crystalline polyester resin, said stabilizer, said colorant, said surfactant, said deionized water, and said wax and said shell is an amorphous polyester resin.

* * * * *